US007900686B2

(12) United States Patent
Kanayama et al.

(10) Patent No.: US 7,900,686 B2
(45) Date of Patent: Mar. 8, 2011

(54) METAL MOLD CASTING MACHINE OF A CASTING APPARATUS

(75) Inventors: Yuji Kanayama, Toyokawa (JP); Takahiro Ono, Toyokawa (JP); Tetsuya Takeshita, Toyokawa (JP)

(73) Assignee: Sintokogio, Ltd., Aichi (JP)

( * ) Notice: Subject to any disclaimer, the term of this patent is extended or adjusted under 35 U.S.C. 154(b) by 462 days.

(21) Appl. No.: 12/064,852

(22) PCT Filed: Aug. 28, 2006

(86) PCT No.: PCT/JP2006/316857

§ 371 (c)(1),
(2), (4) Date: Feb. 26, 2008

(87) PCT Pub. No.: WO2007/026642

PCT Pub. Date: Mar. 8, 2007

(65) Prior Publication Data

US 2010/0224342 A1 Sep. 9, 2010

(30) Foreign Application Priority Data

Aug. 31, 2005 (JP) ..... 2005-250610

(51) Int. Cl.
*B22D 5/02* (2006.01)
*B22D 35/00* (2006.01)

(52) U.S. Cl. ..... 164/326; 164/335

(58) Field of Classification Search ..... 164/323, 164/324, 325, 326, 130, 136, 335, 336
See application file for complete search history.

(56) References Cited

U.S. PATENT DOCUMENTS 6,942,010 B2 * 9/2005 Osugi et al. ..... 164/336
2004/0065429 A1 4/2004 Osugi et al.

FOREIGN PATENT DOCUMENTS

JP 2-295661 12/1990
JP 3-118959 A * 5/1991
JP 2005-118783 5/2005
JP 2005-118783 A * 5/2005

OTHER PUBLICATIONS

Supplemental European Search Report from the European Patent Office in International Application No. EP 06 78 3086 mailed Sep. 14, 2009.

* cited by examiner

*Primary Examiner* — Kevin P Kerns
(74) *Attorney, Agent, or Firm* — Finnegan, Henderson, Farabow, Garrett & Dunner, L.L.P.

(57) ABSTRACT

A metal mold casting machine for a casting apparatus with which the worker can easily carry out his or her work, such as setting a core, cleaning a mold, taking out castings, etc. The casting apparatus includes a turntable 1 that is rotatable in a horizontal plane, and a number of metal mold casting machines 4, 4 that are placed on an upper side at the periphery of the turntable 1. Each of the machines 4, 4 has an opening and closing mechanism 3 for a mold 2. A pouring basin 9, from which molten metal is poured into the mold 2, is mounted on the casting machine, and moves over the mechanism 3 between the peripheral side and the side toward the rotation axis of the turntable 1. The pouring basin 9 is moved to the peripheral side when molten metal is poured into the mold. It is then moved to the side toward the rotation axis of the turntable 1 when work such as taking out of a casting from the mold is carried out.

2 Claims, 3 Drawing Sheets

METAL MOLD CASTING MACHINE OF A CASTING APPARATUS

TECHNICAL FIELD

The present invention relates to an improvement of a metal mold casting machine of a casting apparatus. The apparatus includes a turntable that is rotatable in a horizontal plane, and a number of metal mold casting machines that are placed on the upper side at the periphery of the turntable. The machine has an opening and closing mechanism that opens and closes a mold.

BACKGROUND OF THE INVENTION

One existing metal mold casting machine comprises a mold that can be horizontally split by an opening and closing mechanism for it, and a pouring basin by which molten metal is poured into it.

However, if the metal mold casting machine constructed as above is installed so that a worker would, as usual, stand outside the turntable, the machine will have problems. Namely, it would be difficult to assemble the machine as a part of an apparatus, because a pouring basin would be placed at or around the axis of the turntable, which is at the side opposite the worker, even if a countermeasure, such as a furnace being placed on the axis of the turntable, is taken. Also, handling any oxide layer formed on the surface of molten metal in the pouring basin would be difficult.

Therefore, a metal mold casting machine is suggested. In it the pouring basin is placed at the periphery of the turntable, the mechanism for opening and closing a mold is pivotally mounted so that it causes the mold, which can be horizontally split, to move between a horizontal position and vertical position, and the pouring basin is then fixed on the lower part of the mold at the peripheral side of the turntable. The molten metal is poured into the mold by tilting the pouring basin, together with the mechanism and the mold, toward and around the axis of the turntable (see Japanese Patent Laid-open Publication No. 2005-118783).

DISCLOSURE OF THE INVENTION

However, the conventional metal mold casting machine constituted as above may cause other problems, such as deteriorating workability of setting a core, cleaning the mold, taking out the castings, etc. This is because the worker has to stay away from the mold, since the pouring basin is always placed in front of the worker, i.e., at the periphery of the turntable.

This invention was created to resolve these drawbacks. Its purpose is to provide a metal mold casting machine that causes such work of a worker as taking out the castings to be easier.

To this end, the metal mold casting machine of this invention is used by the casting apparatus. The casting apparatus comprises a turntable that is rotatable in a horizontal plane, and a number of metal mold casting machines that are placed on the upper side at the periphery of the turntable. Each machine has an opening and closing mechanism for a mold. The pouring basin of the casting machine is mounted on the opening and closing mechanism for the mold, so that it can move over the mechanism between the peripheral side and the side toward the rotation axis of the turntable. The pouring basin is moved to the peripheral side when molten metal is poured into the mold, and it is moved to the side toward the rotation axis when the work such as taking out the castings from the mold is carried out.

As discussed above, the casting machine of this invention is used by the casting apparatus. The casting apparatus comprises a turntable that is rotatable in a horizontal plane, and a number of metal mold casting machines that are placed on the upper side at the periphery of the turntable. Each machine has an opening and closing mechanism for a mold. The pouring basin of the casting machine is mounted on the opening and closing mechanism for the mold, so that it can move over the mechanism between the peripheral side and the side toward the rotation axis of the turntable. The pouring basin is moved to the peripheral side when molten metal is poured into the mold, and it is moved to the side toward the rotation axis when work such as taking out the castings from the mold is carried out. Therefore, since the pouring basin is moved to the side toward the rotation axis of the turntable when a worker carries out some work such as setting a core, cleaning a mold, taking out castings, etc., the work of taking out castings, etc., which are carried out by a worker, can be easy.

BRIEF DESCRIPTIONS OF THE DRAWINGS

DESCRIPTION OF A PREFERRED EMBODIMENT

Figure 1:
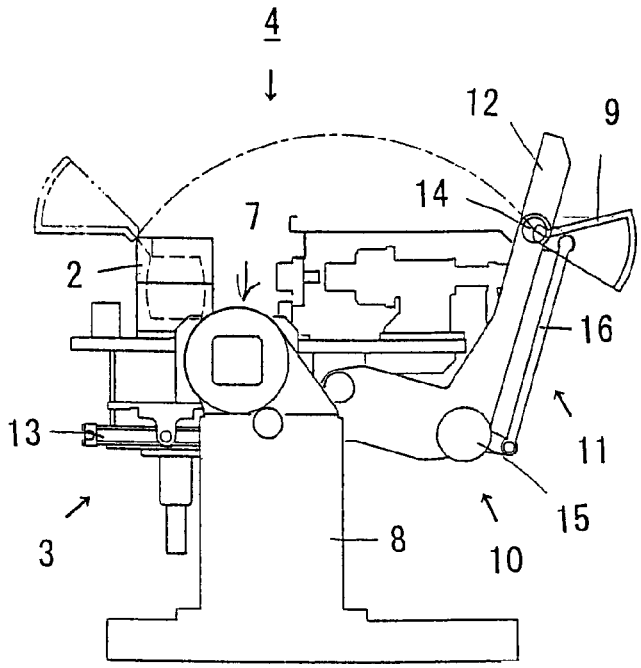
FIG. 1 is a lateral view of an embodiment of the metal mold casting machine of this invention.

Now, one embodiment of the casting apparatus using the metal mold casting machine of this invention is explained referring to FIGS. 1-4. As in FIG. 3, the casting apparatus comprises a turntable 1 and a number of metal mold casting machines 4, 4. The turntable 1 is intermittently rotatable in the direction of the arrow in a horizontal plane. The machines 4, 4 are placed at even intervals on the upper side at the periphery of the turntable 1. Each of the machines 4, 4 has an opening and closing mechanism 3 for a mold. Each of the machines 4, 4 is directed in a radial direction from the center of rotation axis of the turntable 1. Further, a robot 5, which sets a core in the mold 2, and a robot 6, which provides molten metal to a pouring basin 9, are installed with a required distance from each other at the periphery of the turntable 1.

Figure 2:
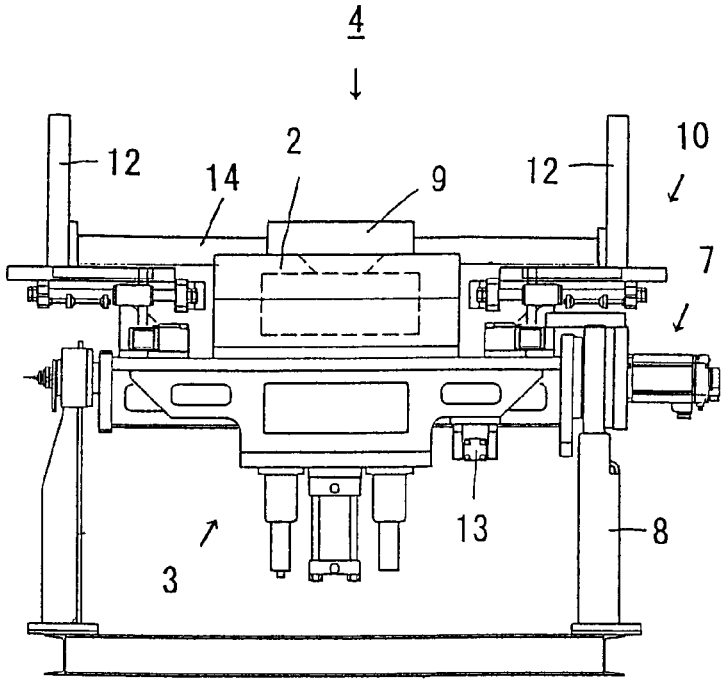
FIG. 2 is an elevation view of the machine in FIG. 1.
Figure 3:
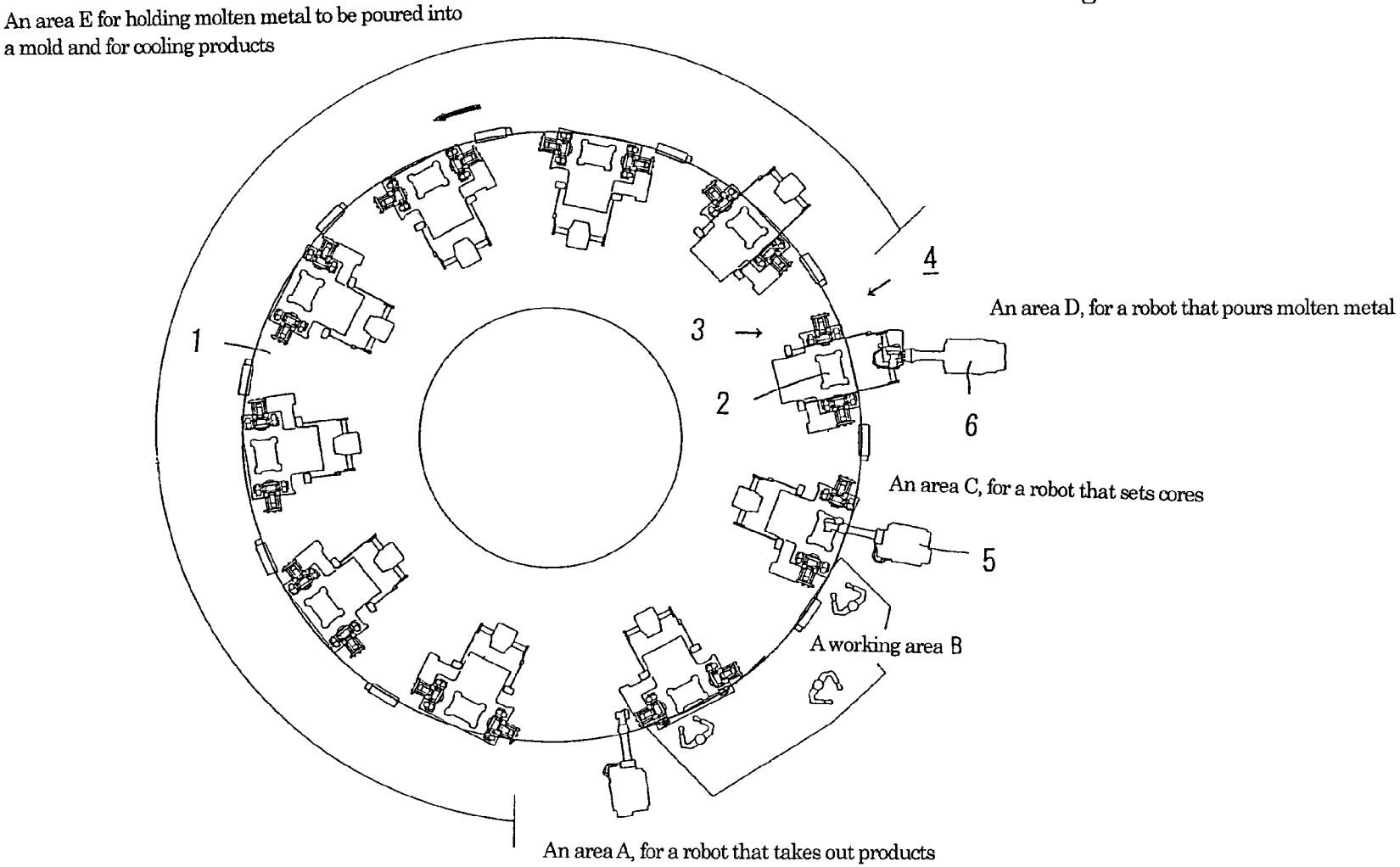
FIG. 3 is a plan view of an embodiment of a casting apparatus that uses the metal mold casting machine of this invention.
Figure 4:
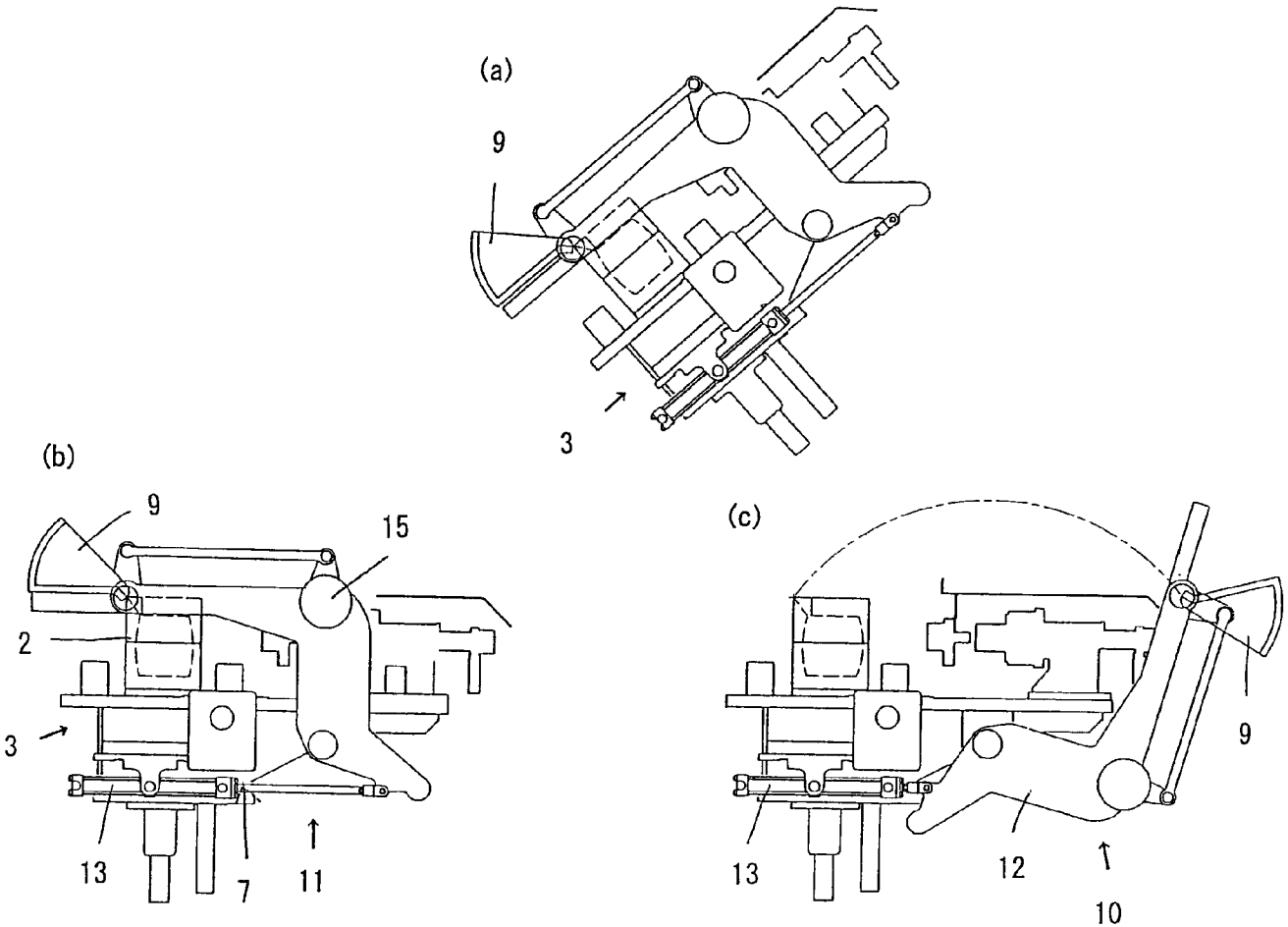
FIG. 4 is an explanatory drawing of the movements of the machine in FIG. 1.

As in FIGS. 1 and 2, each metal mold casting machine 4 comprises a U-shaped supporting frame 8, a pouring basin 9, a pouring basin-moving means 10, and a pouring basin-pivoting mechanism 11. The supporting frame 8 holds the opening and closing mechanism 3 for a mold by a pivoting mechanism 7 that rotates the mechanism 3 up and down. The pouring basin 9 pours molten metal into the mold 2 that is provided in the mechanism 3. The pouring basin-moving means 10 causes the pouring basin 9 to move over the mechanism 3 between the peripheral side and the side toward the rotation axis of the turntable 1. The pouring basin-pivotinq mechanism 11 is located on the pouring basin-moving means 10 and independently rotates the pouring basin 9 up and down.

Also, the pouring basin-moving means 10 comprises a pair of right and left arms 12, 12, and a laterally-facing cylinder 13. Each of the arms 12, 12 is Z-shaped. Its lower bend is supported by the opening and closing mechanism 3 at the right or left end of the opening and closing mechanism 3 so that it can pivot freely. The central part of the cylinder 13 is supported by the opening and closing mechanism 3 so that it can pivot freely. The distal end of the piston rod is connected to the lower end of the arm 12 with a pin. The pair of arms 12, 12 are turned upward and downward in accord with the movement of the cylinder 13, as in FIG. 1.

Further, the pouring basin-pivoting mechanism 11 comprises a supporting shaft 14, a gear motor 15, and a link mechanism 16. The supporting shaft 14 is fixed between the arms 12, 12 of the pouring basin-moving means 10 near the distal end of the arms 12, 12. The supporting shaft 14 pivotably supports the pouring basin 9. The gear motor 15 is mounted on the bent part of the arm 12. One end of the link mechanism 16 is connected to the end of the supporting shaft 14. The other end is fitted on the output shaft of the gear motor 15. Thus, the link mechanism 16 transmits the torque of the gear motor 15 to the supporting shaft 14.

Now, we discuss the procedure of making castings by a casting apparatus configured as described above. First, as in FIG. 4-*a*, the opening and closing mechanism 3 and the pouring basin 9 are tilted counterclockwise by a required angle. Then the robot 6 pours molten metal into the pouring basin 9, which is at the peripheral side of the turntable 1. Next, as in FIG. 4-*b*, the gear motor 15, starts to drive in a normal direction, and causes the pouring basin 9 to be tilted clockwise. The pivoting mechanism 7 moves to cause the opening and closing mechanism 3, etc., to return to the horizontal position. Thus, the molten metal in the pouring basin 9 is poured into the mold 2. After that, as in FIG. 4-*c*, the cylinder 13 of the pouring basin-moving means 10 is shortened and causes the arms 12, 12 to rotate clockwise so as to move the pouring basin 9 to the side toward the rotation axis of the turntable 1. Then, a worker can do his or her jobs, i.e., taking out the castings from the mold 2 or cleaning it, without any interference of the pouring basin 9.

What is claimed is:

1. A metal mold casting machine for use in a casting apparatus having, a turntable that is rotatable in a horizontal plane about a rotation axis and on which is placed a number of metal mold casting machines on an upper side at the periphery of the turntable, each of the metal mold casting machines comprising an opening and closing mechanism for a mold, a pouring basin for holding molten metal mounted on the machine a pouring basin-moving means for moving the pouring basin between a position over the opening and closing mechanism for the mold at a peripheral side of the turntable and a position away from over the mechanism at a side of the turntable toward the rotation axis, wherein the pouring basin is moved to the peripheral side when molten metal is to be poured into the mold, and is moved to the side toward the rotation axis when work is to be carried out on the mold, and a pouring basin-pivoting mechanism for pouring molten metal from the pouring basin into the mold when the pouring basin is located at the peripheral side of the turntable.

2. The metal mold casting machine of claim 1, including a pivoting mechanism for pivoting the opening and closing mechanism and the pouring basin between a tilted position and a horizontal position on the turntable.

* * * * *

UNITED STATES PATENT AND TRADEMARK OFFICE

CERTIFICATE OF CORRECTION

PATENT NO. : 7,900,686 B2
APPLICATION NO. : 12/064852
DATED : March 8, 2011
INVENTOR(S) : Yuji Kanayama et al.

It is certified that error appears in the above-identified patent and that said Letters Patent is hereby corrected as shown below:

In claim 1, column 4, line 9, "having, a turntable" should read --having a turntable--.

In claim 1, column 4, lines 14-15, "machine a pouring" should read --machine, a pouring--.

Signed and Sealed this
Twelfth Day of February, 2013

Teresa Stanek Rea
*Acting Director of the United States Patent and Trademark Office*